US006412263B1

(12) United States Patent
Lee et al.

(10) Patent No.: US 6,412,263 B1
(45) Date of Patent: Jul. 2, 2002

(54) REINFORCING STEEL CORD FOR RUBBER PRODUCTS, METHOD AND DEVICE FOR PRODUCING SUCH STEEL CORDS

(75) Inventors: Byung-Ho Lee; Seung-Ho Lim, both of Kyungsangbuk-Do (KR)

(73) Assignee: Hongduk Steel Cord Co., Ltd. (KR)

( * ) Notice: Subject to any disclaimer, the term of this patent is extended or adjusted under 35 U.S.C. 154(b) by 0 days.

(21) Appl. No.: 09/587,372

(22) Filed: Jun. 2, 2000

(30) Foreign Application Priority Data

Jun. 3, 1999 (KR) ..... 99-20491
Jun. 7, 1999 (KR) ..... 99-21025

(51) Int. Cl.[7] ..... D07B 1/06

(52) U.S. Cl. ..... 57/210; 57/204; 57/206; 57/207; 57/211; 57/212; 57/213; 57/214; 57/215; 57/218; 57/219; 57/230; 57/231; 57/236; 57/237

(58) Field of Search ..... 57/204, 206, 207, 57/210, 211, 212, 213, 214, 215, 218, 219, 230, 231, 236, 237, 902; 152/451

(56) References Cited

U.S. PATENT DOCUMENTS 3,402,546 A * 9/1968 Peene ..... 57/236
3,996,733 A * 12/1976 Holmes ..... 57/145
4,709,544 A * 12/1987 Charvet ..... 57/128

* cited by examiner

*Primary Examiner*—Danny Worrell
*Assistant Examiner*—Shaun R Hurley
(74) *Attorney, Agent, or Firm*—Perman & Green, LLP

(57) ABSTRACT

A reinforcing steel cord for rubber products, such as steel belted radial tires or conveyor belts, is disclosed. This steel cord is improved in rubber penetration and ageing adhesive force relative to the rubber material. The steel cord is formed by twisting a plurality of brass coated external element wires around a flat and spirally twisted core, with the twisted direction of the core being the same as or opposite to that of the resulting steel cord. In the steel cord, the pitch of the twisted core is set to allow the core to be twisted 0.2 to 2 times within the pitch of the cord, thus preferably forming sufficient interspaces between the core and the external wires in addition to the interspaces between the external wires. Since the rubber material is completely filled in the steel cord due to such interspaces, the steel cord is remarkably improved in buckling fatigue resistance, rubber penetration, air permeability, rubber adhesive force, ageing adhesive force relative to rubber, protection of brass coated surfaces of wires, and workability during a process of producing rubber products. The steel cords of this invention are most preferably used as a reinforcing material for steel belted radial tires.

2 Claims, 8 Drawing Sheets

REINFORCING STEEL CORD FOR RUBBER PRODUCTS, METHOD AND DEVICE FOR PRODUCING SUCH STEEL CORDS

BACKGROUND OF THE INVENTION

1. Field of the Invention

The present invention relates, in general, to reinforcing steel cords for a variety of rubber products, such as tires and conveyor belts, and, more particularly, to a reinforcing steel cord formed by twisting a plurality of external element wires around a twisted flat core, thus having a plurality of interspaces between the core and the wires in addition to a plurality of interspaces between the wires, the steel cord thus allowing the rubber material to be more effectively penetrated into the cord through the interspaces during a production process of the rubber products and being free from an undesirable movement of the core within the cord, and being improved in its ageing adhesive force with the rubber material, the present invention also relating to a method and device for producing such steel cords.

2. Description of the Prior Art

As well known to those skilled in the art, steel cords are used as reinforcing materials for rubber products or elastomer products, such as tires or conveyor belts. The steel cords, used as the reinforcing materials for such rubber products, are superior in desired characteristics, such as strength, modulus, heat resistance and fatigue resistance, in comparison with other conventional reinforcing materials, such as organic or inorganic fibers. Therefore, the steel cords have been more preferably used as reinforcing materials of such rubber products than such other reinforcing materials. Particularly when such steel cords are used as the material of the carcass or the steel belt layer of a radial tire, the steel cords remarkably improve the fretting resistance, durability and steering response of the tire.

A steel cord, used as a reinforcing material for radial tires or conveyor belts, is typically formed by twisting a plurality of element wires together to form a strand structure or by twisting a plurality of strands together to form a wire rope structure. In order to allow such steel cords to perform a desired reinforcing function within a rubber product, it is necessary for the steel cords to be physically, chemically and firmly integrated with the rubber material.

FIGS. 1 to 5 are sectional views, respectively showing examples of conventional reinforcing steel cords for radial tires.

FIG. 1 shows a steel cord, which has a double layer twisted structure and is typically used as the belt layer material of steel belted radial tires for large-scaled vehicles, such as trucks or buses. AS shown in the drawing, the steel cord 1 has a 3+6 element wire structure wherein six external element wires 1*b* are twisted around a core to form a double layer twisted structure, with the core being formed by twisting three core element wires la together to form a core.

However, the above double layer twisted steel cord 1 is problematic in that it is somewhat complex in structure since it has many element wires. In addition, the above steel cord 1 has to be produced through two twisting processes, or a primary twisting process of twisting the three core element wires la to form a core and a second twisting process of twisting the six external element wires 1*b* around the core to form a cord. This finally complicates the process of producing the reinforcing steel cords in addition to an increase in the production cost of the steel cords. In the above steel cord 1, a central space H is formed at the center of the three twisted core element wires 1*a*, but it is almost impossible for the rubber material to be penetrated into the central space H during a tire production process. This steel cord 1 is thus undesirably reduced in its ageing adhesive force with the rubber material.

Another problem experienced in the above steel cord 1 resides in that the cord 1 is somewhat heavy and has a large diameter, thus being not agreeable with the recent trend of lightness of tires or of an improvement in maximum safe mileage.

In an effort to overcome the above-mentioned problems of the double layer twisted steel cord 1, a steel cord, having a single layer twisted open structure, has been proposed as disclosed in Japanese Laid-open Publication No. Heisei. 6-65,877. This Japanese steel cord, shown in FIG. 2 of the accompanying drawings, has a small diameter in addition to a simple construction. This steel cord is also produced through a single process free from the primary twisting step of forming the twisted core different from the steel cord 1 of FIG. 1. As shown in the drawing, a plurality of element wires, for example, six element wires 2*a* are twisted together to form a steel cord 2 while being respectively and exceedingly preformed. This steel cord 2 is, thereafter, externally forced to be somewhat flattened, thus having a generally elliptical cross-section. In the above steel cord 2, a plurality of interspaces S are formed between the element wires 2*a*.

The above steel cord 2 is produced through a single twisting process, thus simplifying the cord production process in addition to a reduction in the cord production cost. In the above steel cord 2, the element wires 2*a* are somewhat loosely integrated since they are respectively and exceedingly preformed during the process of producing the cord 2, thus forming the desired interspaces S between the wires 2*a*. Due to such interspaces S, the rubber material is allowed to be penetrated into the steel cord 2 during a process of producing a steel belted radial tire. In addition, since each flat surface of the above steel cord 2 is almost kept on the same plane within the total length of the cord 2, it is possible to reduce the thickness of a resulting tire while preferably reducing the weight of the tire.

However, the above steel cord 2 is problematic in that since the element wires 2*a* are loosely twisted together while being respectively preformed, the cord 2 is exceedingly high in its elongation even in the case of application of low load. This cord 2 is thus difficult to be handled by a worker during a tire production process. In order to preform the element wires 2*a* within a predetermined range, it is necessary to mechanically process the element wires 2*a* using a specific preforming jig, such as a plate-type preforming device or a rotary-type preforming device. In such a case, severe friction is generated at the contact portions between the element wires 2*a* and the jig, thus undesirably removing brass coating layers from the surfaces of the element wires 2*a* and damaging the wires 2*a*. This finally reduces the rubber adhesive force and buckling fatigue resistance of the steel cord 2.

Particularly, the above steel cord 2 is very difficult to handle during a process of producing desired rubber products having the cords 2 and necessarily has a fine difference in the low load elongation between the wires 2*a*. Therefore, it is difficult to regularly array the steel cords 2 within a topping sheet, thus resulting in irregular quality of resulting topping sheets. In the case of tires using belt layers made of such steel cords 2, the steel cords 2 may be easily loosened during a rotation of the tires on a street. This may finally allow the belt layers to be unexpectedly deformed, thus reducing the steering response of the tires and occasionally causing safety hazards.

FIG. 3 shows a conventional steel cord 3, which has a 1+6 element wire structure wherein six external element wires 3*b* are twisted around a core 3*a*, made of one core element wire having a circular cross-section, to form a cord. On the other hand, FIG. 4 shows another conventional steel cord 4, which has a 1+6 element wire structure, with six external element wires 4*b* being twisted around a core 4*a*, made of one core element wire, to form a steel cord in the same manner as that described for the cord 3 of FIG. 3. However, the core 4*b* of this steel cord 4 is rolled by a press roll pair to have a flat cross-section different from the that of the cord 3.

In the steel cords 3 and 4 each having a 1+6 element wire structure of FIGS. 3 and 4, the structural stability of the cords 3 and 4 is improved due to the cores 3*a* and 4*a*. It is also possible to reduce the elongation when the cords 3 and 4 are stretched. However, the above steel cords 3 and 4 are problematic in that it is very difficult for the rubber material to penetrate into the junctions between the cores 3*a*, 4*a* and the external element wires 3*b*, 4*b* since the external element wires are densely twisted around the core while being brought into continuous linear contact with the core.

In a steel belted radial tire having a belt layer consisting of the above reinforcing steel cords 3 or 4, the steel belt layer repeats a buckling action during a rotating action of the tire on a street, thus being repeatedly tensioned, compressed and thereby severely pressurized. Due to such a buckling action of the steel belt layer, the neighboring element wires 3*a* and 3*b*, 4*a* and 4*b* of each steel cord are brought into frictional contact with each other, thus being gradually fretted at their frictional contact surfaces and being frictionally fatigued at the surfaces. This may finally cause a breakage of some steel cords within the belt layer.

Another problem of the above steel cords 3 and 4 resides in that the core 3*a* or 4*a* fails to be integrated with external element wires 3*b* or 4*b* by the rubber material, but is freely kept within the central space defined by the twisted external wires 3*b* or 4*b*. Therefore, each of the steel cords 3 and 4 undesirably results in a core migration wherein the core 3*a* or 4*a* moves to the edge of the belt layer.

FIG. 5 is a sectional view of a conventional steel cord 5, which has a 1+6 element wire structure with some external element wires being partially preformed to overcome the above-mentioned problems experienced in the steel cords 3 and 4 of FIGS. 3 and 4. In the steel cord 5 of FIG. 5, some external element wires 5*b*', twisted around the core 5*a* to form a cord, are preformed, and so the junctions between the preformed element wires 5*b*' are partially open, thus improving penetration of the rubber material into the steel cord 5.

However, the above steel cord 5 has the following problems. That is, the steel belt layer consisting of such steel cords 5 repeats a buckling action during a continuous rotating action of a tire on a street, thus being repeatedly tensioned, compressed and thereby instantaneously and severely impacted. In such a case, the steel cords 5 within the steel belt layer are overloaded. Therefore, the tensile force and the compression force are concentrated on the non-preformed external wires 5*b*, having a low preforming ratio or being low in the supplied element wire length per unit length of the steel belt layer. The above steel cord 5 is thus inferior in structural stability.

In order to preform the element wires 5*b*' within a predetermined range, it is necessary to mechanically process the element wires 5*b*' using a specific preforming jig, such as a toothed gear. In such a case, a severe friction is generated at the contact portions between the element wires 5*b*' and the jig, thus undesirably removing brass coating layers from the surfaces of the element wires 5*b*' and damaging the wires 5*b*'. This finally reduces the rubber adhesive force and buckling fatigue resistance of the steel cord 5.

SUMMARY OF THE INVENTION

Accordingly, the present invention has been made keeping in mind the above problems occurring in the prior art, and an object of the present invention is to provide a reinforcing steel cord for rubber products, which is formed by twisting a plurality of external element wires around a core, the core being improved in its structure so as to minimize the continuous contact area between the core and external element wires and to form desired interspaces between the core and the wires in addition to a plurality of interspaces between the wires, thus allowing the rubber material to be more effectively penetrated into and filled in the interspaces during a production process of the rubber products and being improved in its ageing adhesive force with the rubber material.

Another object of the present invention is to provide a reinforcing steel cord for rubber products, which is very firmly integrated with the rubber material of a desired rubber product, thus having a low elongation in the case of application of low load and being improved in its structural stability, and which effectively resists any buckling action and is improved in its fretting resistance while being free from damaging the brass coating layers of the element wires, and which completely eliminates the problem of a core migration.

A further object of the present invention is to provide a method and device for producing such reinforcing steel cords.

In order to accomplish the above objects, the present invention provides a reinforcing steel cord for rubber products, which is formed by twisting a plurality of brass coated external element wires around a flat and spirally twisted core, with the twisted direction of the core being the same as or opposite to that of the resulting steel cord.

In the steel cord of this invention, the flat core is twisted in the same direction as that of the resulting cord or in a direction opposite to that of the cord, with the pitch of the core being 0.2 to 2 times the pitch of the cord. Therefore, it is possible to form a plurality of desired interspaces between the core and the external wires and between the external wires within the steel cord.

In an embodiment of this invention, at least one of the external wires, twisted around the flat and spirally twisted core to the cord, has a flat cross-section in addition to a spirally twisted structure in the same manner as that of the core.

The above-mentioned interspaces within the steel cord of this invention improve the rubber penetration into the cord, thus allowing the rubber material to be completely filled in the cord. The rubber material filled in the interspaces almost completely prevents the core from coming into direct contact with the external wires in addition to a prevention of contact between the external wires.

Therefore, when such steel cords are set within a steel belted radial tire through a vulcanizing process, the rubber material effectively penetrates into the cords through the open interspaces and is filled in the cords. This effectively prevents an abrasion of the cords caused by the friction contact between the wires and minimizes an undesirable breakage of the wires within the steel cords. The rubber material within the interspaces around the core firmly holds the position of the core within the cord, thus eliminating the problem of a core migration. The steel cord of this invention is produced without using a conventional preforming device undesirably scratching or damaging the brass coated surfaces of the steel wires, thus improving the rubber adhesive force of the steel cord in addition to an improvement in ageing adhesion of the cord with the rubber material.

The steel cord of this invention has a 1+n element wire structure ("n" representing the number of external element wires). In the steel cord, it is preferable to set the number "n" to one of three to nine. The above steel cord, having a first multi-layer twisted structure, may be directly used as a reinforcing material for rubber products or may be used as a core of another steel cord having a second multi-layer twisted structure. The above steel cord, having the first multi-layer twisted structure, may be also used as strands of another steel cord having a closing structure, which has been typically expressed using the symbol "x" in the art. Alternatively, the steel cord of this invention may have a combined structure, having both such a closing structure and a multi-layer twisted structure. Such a multi-layer twisted structure has been typically expressed using the symbol "+" in the art.

The above-mentioned reinforcing steel cord for rubber products is produced through the steps of cold-rolling a brass-plated steel wire having a circular cross-section to give the steel wire a flat cross-section, axially and spirally twisting the steel wire around an axis of the wire, thus forming a desired flat and spirally twisted core, and twisting a plurality of external wires around the core to form a desired twisted steel cord in a way such that at least one of the twisted direction and the pitch of the twisted core is different from that of the twisted cord.

BRIEF DESCRIPTION OF THE DRAWINGS

The above and other objects, features and other advantages of the present invention will be more clearly understood from the following detailed description taken in conjunction with the accompanying drawings, in which:

FIGS. 6*a* and 6*b* are views, showing the construction of a reinforcing steel cord in accordance with the primary embodiment of the present invention, in which:

FIG. 6*a* is a front view of the steel cord, showing construction of the cord; and FIG. 6*b* shows cross-sections of the steel cord taken along the lines A—A, B—B, C—C, D—D and E—E of FIG. 6*a;*

FIGS. 7*a* and 7*b* are views, showing cores used in the steel cord according to this invention, in which:

FIG. 7*a* is a front view of an S-twist core in accordance with the primary embodiment; and FIG. 7*b* is a front view of a Z-twist core in accordance with the first modification of the primary embodiment;

FIGS. 9*a* and 9*b* are sectional views of steel cords, individually formed by twisting a plurality of external element wires around a steel cord of the primary embodiment, used as a core, to form a multi-layer twisted structure in accordance with the second embodiment of the present invention, in which:

FIG. 9*a* shows a steel cord, with all the external element wires having a circular cross-section according to the second embodiment; and FIG. 9*b* shows a steel cord, with at least one of the external element wires being flat and spirally twisted according to the first modification of the second embodiment;

FIGS. 10*a* and 10*b* are sectional views of steel cords, individually formed by twisting three steel cords of the primary embodiment, used as strands, together to form a closing structure in accordance with the third embodiment of the present invention, in which:

FIG. 10*a* shows a steel cord, with all the external element wires, twisted around a flat and spirally twisted core of each strand, having a circular cross-section according to the third embodiment; and FIG. 10*b* shows a steel cord, with at least one of the external element wires being flat and spirally twisted according to the first modification of the third embodiment;

FIGS. 13 to 16 are views, each showing a process of producing steel cords of this invention using a twisting device, in which:

FIG. 13 shows a cord production process using an out-in double twisting device;

FIG. 14 shows a cord production process using an in-out double twisting device;

FIG. 15 shows a cord production process using an in-out double twisting device of the type different from the device of FIG. 14; and FIG. 16 shows a cord production process using a tubular-type twisting device.

DESCRIPTION OF THE PREFERRED EMBODIMENTS

Figure 6A:
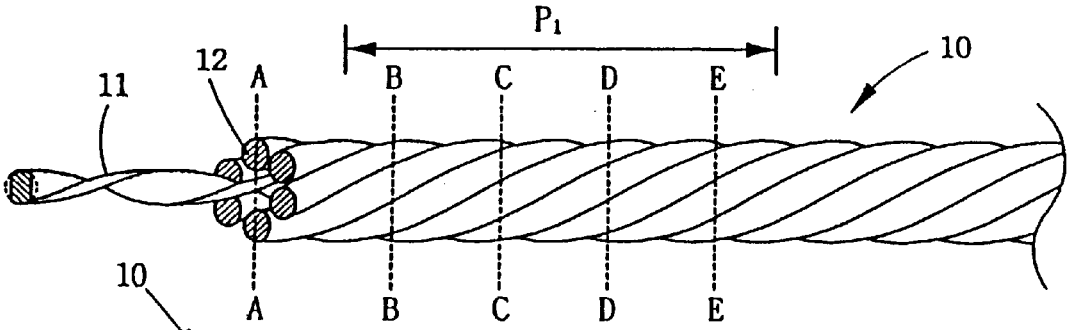
Figure 6B:
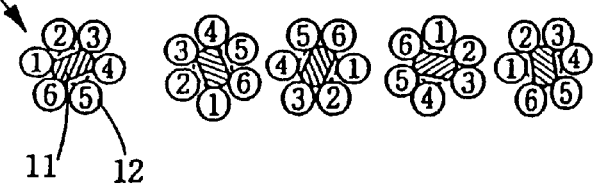
Figure 7A:
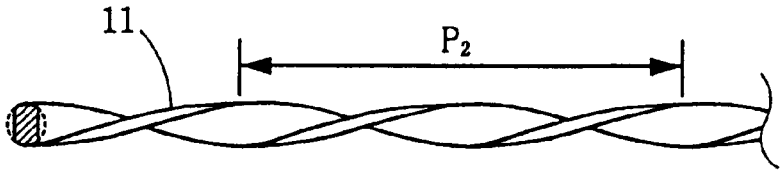
Figure 7B:
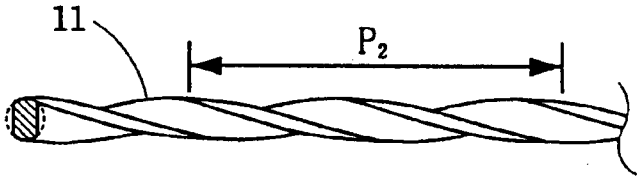
Figure 8:
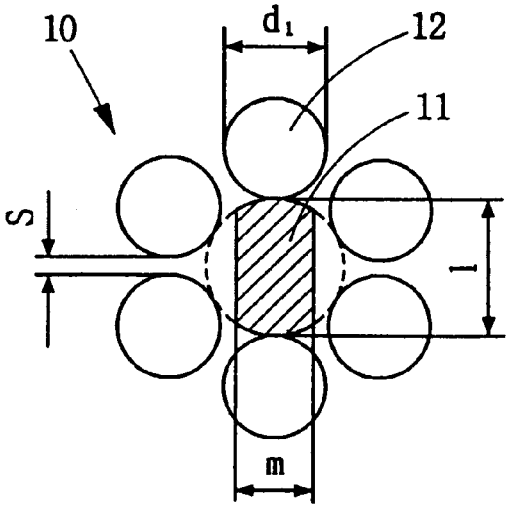
FIG. 8 is an enlarged sectional view of the steel cord of the primary embodiment of this invention.

FIG. 6*a* is a front view, showing the construction of a reinforcing steel cord in accordance with the primary embodiment of the present invention. FIG. 6*b* shows cross-sections of the steel cord taken along the lines A—A, B—B, C—C, D—D and E—E of FIG. 6*a*. FIG. 7*a* is a front view, showing an S-twist core used in the steel cord of this invention. FIG. 7*b* is a front view, showing a Z-twist core used in the steel cord of this invention. FIG. 8 is an enlarged sectional view of the steel cord of this invention.

As shown in the drawings, the steel cord 10 of this invention has a core 11, with six external element wires 12 individually plated with a brass layer and twisted around the core 11, thus forming a desired steel cord. The core 11 is formed by lengthwisely twisting a flat wire to form a spirally twisted structure.

In the present invention, the above core 11 may be lengthwisely twisted in the same direction as the twisted direction of the cord 10 as shown in FIG. 7*a*, or may be lengthwisely twisted in a direction opposite to the twisted direction of the cord 10 as shown in FIG. 7*b*.

The pitch $P_2$ of the twisted core 11 is set to allow the core 11 to be twisted 0.2 to 2 times within the pitch $P_1$ of the cord 10, thus increasing the space geometrically occupied by the core 11 within the cord 10 while providing a plurality of interspaces S between external element wires 12 as best seen in FIG. 8. Therefore, an interspace not less than 0.02 mm is formed between the neighboring external element wires 12 within the pitch $P_1$ of the steel cord 10 having a 1+n element wire structure.

In such a case, the pitch $P_2$ of the twisted core 11 is kept almost regularly within the total length of the steel cord 10. In the present invention, the twisted structure of the core 11 may be changed into a combined structure, wherein the core 11 is partially twisted in the same direction as the twisted direction of the cord 10 at first several portions and is not twisted at second several portions, and is twisted in a direction opposite to the twisted direction of the cord 10 at the remaining portions.

In the steel cord 10 of this invention, a plurality of open interspaces are formed between the core 11 and the external element wires 12 and between the wires 12, thus improving penetration of the rubber material into the steel cord 5 and being filled with the rubber material during a vulcanizing process of production of a rubber product. This finally improves the ageing adhesive force of the steel cord 10 with the rubber material and almost completely eliminates the problems of fretting at the junctions and of a core migration.

In order to accomplish the above-mentioned advantages and operational effects of the steel cord 10, it is necessary to appropriately set the diameter of the external element wires 12 and the flatness ratio and diameter of the core 11 in addition to the pitch $P_1$ of the cord 10.

In the present invention, both the open interspaces between the wires 12 and the space occupied by the wires 12 at the central portion of the cord 10 are preferably increased when the diameter of the core 11 is increased with a reduction in the diameter of each wire 12 or when the flatness ratio of the core 11 is increased. In such a case, the penetration of the rubber material into the steel cord 10 is improved. However, when the diameter and flatness ratio of the core 11 are exceedingly increased, the diameter of a resulting steel cord 10 is increased, thus undesirably thickening a rubber topping sheet.

Therefore, in order to improve both the penetration of the rubber material into the cord 10 and the structural stability of the cord 10 without increasing the diameter of a resulting steel cord, it is necessary to appropriately set the diameter of the external element wires 12 and the flatness ratio and diameter of the core 11 in addition to the pitch $P_1$ of the cord 10 on the basis of the following expressions of relation (1).

Expressions of Relation (1)

$$0.7d_1 \leqq d_2 \leqq 1.3d_1$$

$$1.05 \leqq F = l/m \leqq 2.0$$

$$l = d_2\{1 + \Pi/2 \cdot (\theta/360)/(\cos\theta/2) - 1/2 \sin\theta/2\}$$

$$\theta = 2\cos^{-1} m/d_2$$

$$p_2 = \pm(0.2 \sim 2)p_1$$

wherein $d_1$ is the diameter (mm) of each external element wire.

$d_2$ is the diameter (mm) of the original core before being flattened.

F is the flatness ratio of the core.

l is the major axial diameter (mm) of the flat core.

m is the minor axial thickness (mm) of the flat core.

θ is the angle (degree) of flatness of the core.

$P_1$ is the pitch (mm) of the twisted cord.

$P_2$ is the pitch (mm) of the twisted core.

In the present invention, the diameter of each external element wire 12 and the diameter of the original core 11 before being flattened are preferably set to 0.1–0.5 mm. In addition, the content of carbon C in each of the core 11 and wires 12 is set to 0.65–1.1 wt %. It is also preferable to plate the surfaces of the core 11 and wires 12 with brass.

The above-mentioned limitation in dimensions and components of the steel cord 10 of this invention is determined as follows.

In the steel cord 10 of this invention, the pitch $P_2$ of the twisted core 11 is set to allow the core 11 to be twisted 0.2 to 2 times within the pitch $P_1$ of the cord 10 in the same direction as the twisted direction of the cord 10 or in a direction opposite to the twisted direction of the cord 10, thus forming open interspaces between the core 11 and the wires 12. When the pitch $P_2$ is set to allow the core 11 to be twisted less than 0.2 times within the pitch $P_1$, it is very difficult to twist the core 11 to form a desired structure due to an exceedingly high rotating velocity of a core shaping unit used for spirally twisting the core 11. On the other hand, when the pitch $P_2$ is set to allow the core 11 to be twisted more than 2 times within the pitch $P_1$, it is almost impossible to form the desired interspaces between the core 11 and the wires 12.

In the present invention, the flatness ratio F of the core 11 is set to 1.05–2.0. When the flatness ratio F is higher than 2.0, the penetration of the rubber material into the cord 10 is improved, but the diameter of the cord 10 is exceedingly enlarged, thus undesirably thickening the rubber topping sheet. On the other hand, when the flatness ratio F is lower than 1.05, the penetration of the rubber material into the cord 10 is reduced since the interspaces between the core 11 and wires 12 are reduced. Therefore, in order to accomplish the recent trend of lightness of tires and the penetration of the rubber material into the cord 10, the flatness ratio F of the core 11 has to be set to 1.05–2.0.

Figure 9A:
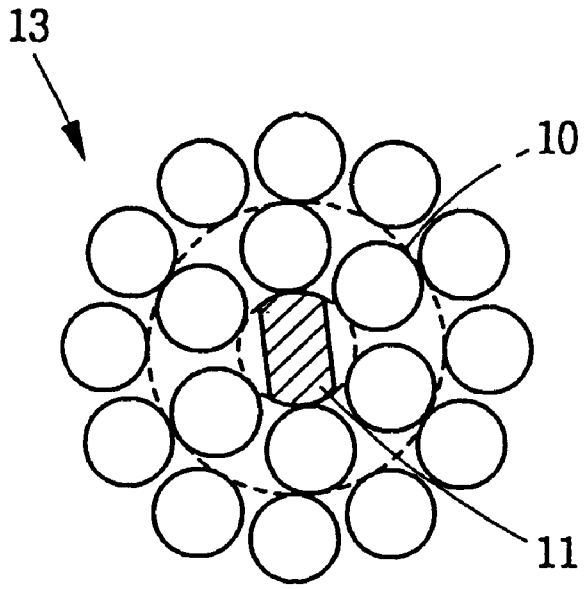
Figure 9B:
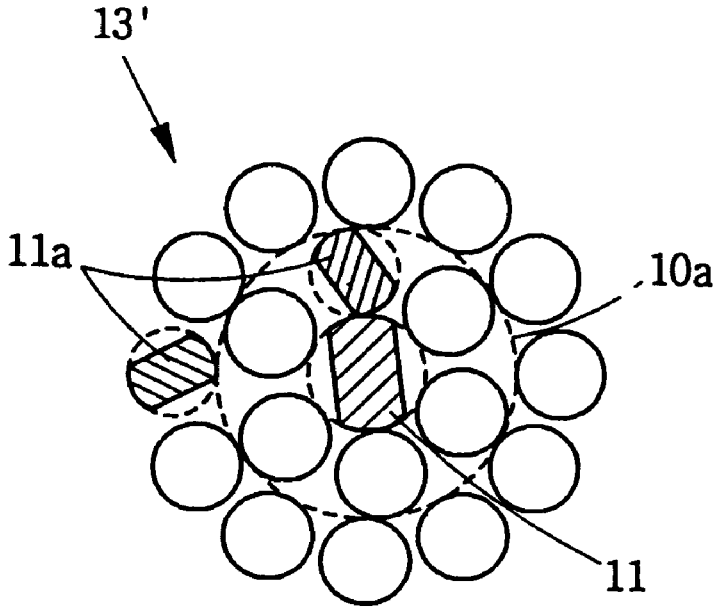

FIGS. 9*a* and 9*b* are sectional views of steel cords 13 and 13', individually formed by twisting a plurality of external element wires around a steel cord 10 or 10*a* of the primary embodiment, used as a core, to form a multi-layer twisted structure in accordance with the second embodiment of this invention. Of FIGS. 9*a* and 9*b*, the first shows a steel cord, with all the external element wires having a circular cross-section according to the second embodiment, while the second shows a steel cord, with one or more external element wires being flat and spirally twisted according to the first modification of the second embodiment. In the drawings, the flat and spirally twisted core is designated by the reference numeral 11, while the flat and spirally twisted external element wires are designated by the reference numeral 11*a*.

Figure 10A:
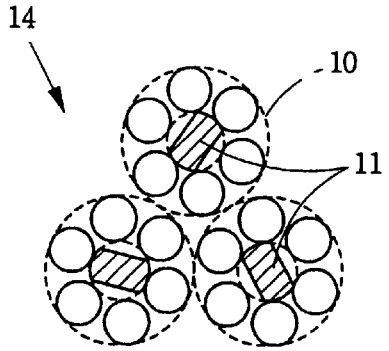
Figure 10B:
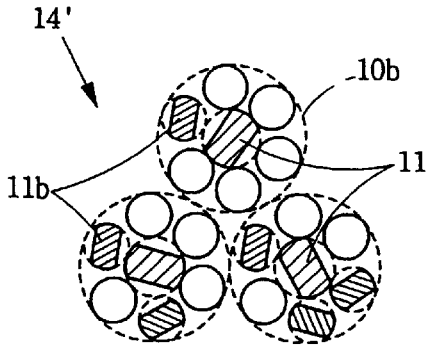

FIGS. 10*a* and 10*b* are sectional views of steel cords 14 and 14', individually formed by twisting three steel cords 10 or 10*b* of the primary embodiment, used as strands, together to form a closing structure in accordance with the third embodiment of this invention. Of FIGS. 10*a* and 10*b*, the first shows a steel cord 14, with all the external element wires, twisted around a flat and spirally twisted core 11 of each strand 10, having a circular cross-section according to the third embodiment, while the second shows a steel cord 14', with one or more external element wires being flat and spirally twisted according to the first modification of the third embodiment. In FIG. 10*b*, the flat and spirally twisted external element wires are designated by the reference numeral 11*b*.

Figure 11:
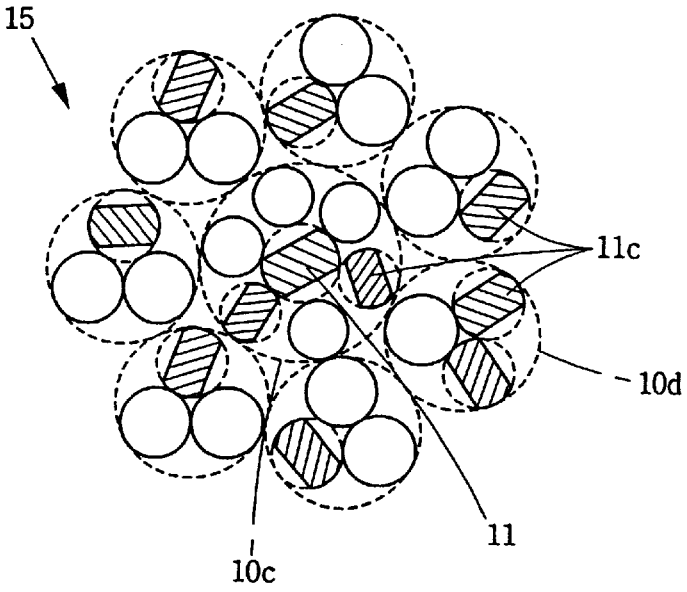
FIG. 11 is a sectional view of a steel cord having both a multi-layer twisted structure and a closing structure in accordance with the fourth embodiment of the present invention.

FIG. 11 is a sectional view of a steel cord 15 having both a multi-layer twisted structure and a closing structure in accordance with the fourth embodiment of the present invention. In the embodiment of FIG. 11, seven strands 10*d* are twisted around a core 10*c* to form a desired cord 15. In such a case, each strand 10*d* is formed by twisting three element wires, including at least one flat and spirally twisted wire 11*c*, together to form a single layer twisted structure. On the other hand, the core 10*c* is formed by twisting six external element wires, including at least one flat and spirally twisted wire 11*c*, around a flat and spirally twisted core 11 to form a double layer twisted structure.

That is, the steel cords of this invention may be set within a desired rubber product, such as a radial tire, so as to be used as reinforcing materials for the rubber product. Alternatively, the steel cords of this invention may be used as cores of steel cords having a multi-layer twisted structure and may be used as strands of steel cords having a closing structure.

Hereinbelow, the process of producing the steel cords of this invention and the construction of a steel cord producing device of this invention will be described in detail with reference to FIG. 12, which shows the construction of a unit preferably used in a step of the process of producing the steel cords of this invention.

Figure 12:
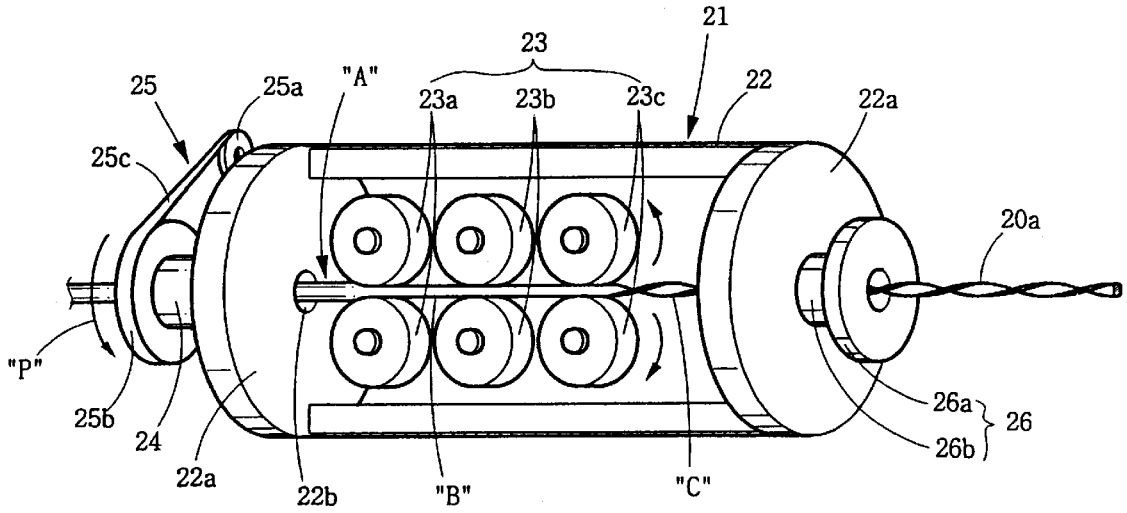
FIG. 12 is a partially broken perspective view, showing the construction of a core shaping unit included in a steel cord twisting device of this invention.

FIG. 12 is a partially broken perspective view, showing the construction of a core shaping unit 21 used in the process of producing the steel cords of this invention. The core shaping unit 21 is installed on a core passage within a steel cord twisting device at a position just around the outlet end of a core bobbin (not shown).

As shown in FIG. 12, the core shaping unit 21, used for flattening and spirally twisting a core 20*a*, comprises a cylindrical housing 22 having a core passing hole 22*b* at the center of each end plate 22*a* thereof. A press roll unit 23 is set along the core passage within the housing 22. A hollow cylindrical rotating shaft 24 is externally and centrally fixed to the inlet end plate 22*a* of the housing 22. The unit 21 also has a power transmission mechanism 25 used for transmitting a rotating force to the rotating shaft 24.

On the other hand, a core distributing guide 26, consisting of a centrally holed disc 26*a* integrated with a hollow cylindrical shaft 26*b*, is externally and centrally fixed to the outlet end plate 22*a* of the housing 22.

The press roll unit 23 comprises a plurality of pairs of press rolls 23*a*, 23*b* and 23*c*, which are arranged along the core passage within the housing 22. In such a case, the two rolls of each pair of press rolls 23*a*, 23*b* or 23*c* are oppositely positioned around the core passage while being spaced apart from each other to form a predetermined nip between them. The rotating shafts of the above rolls 23*a*, 23*b* and 23*c* are rotatably held by brackets (not shown) within the housing 22 while being supported by bearings (not shown).

In the embodiment of FIG. 12, the power transmission mechanism 25 comprises a belt transmission mechanism consisting of a drive pulley 25*a* connected to the output shaft of a drive motor (not shown). The mechanism 25 also has a driven pulley 25*b*, which is concentrically fixed to the outside end of the rotating shaft 24, with an endless belt 25*c* wrapped around the two pulleys 25*a* and 25*b* so as to transmit the rotating force of the drive pulley 25*a* to the driven pulley 25*b*.

Of course, it should be understood that the belt transmission mechanism 25 may be changed with another conventional power transmission mechanism, such as a chain transmission mechanism or a gear transmission mechanism. In the case of a chain transmission mechanism, the two pulleys 25*a* and 25*b* are changed with two sprockets and the belt 25*c* is changed with a chain wrapped around the two sprockets, In the operation of the above core shaping unit 21, the core 20*a*, having a circular cross-section and being fed from a bobbin (not shown), is primarily introduced into the housing 22 through the hollow rotating shaft 24 of the inlet end plate 22*a* and passes through the nips between the press roll pairs 23*a*, 23*b* and 23*c*, and is discharged from the housing 22 through the core distributing guide 26 of the outlet end plate 22*a*. In the present invention, each pair of press rolls is designed to be adjustable in the pressing nip as desired.

The above unit 21 is operated as follows to plastically deform the core 20*a* to give the core a flat cross-section and to spirally and longitudinally twist the flat core 20*a*.

That is, the core 20*a*, introduced into the housing 22 through the hollow rotating shaft 24 of the inlet end plate 22*a*, passes through the nips between the press roll pairs 23*a*, 23*b* and 23*c*. In such a case, the press roll pairs 23*a*, 23*b* and 23*c* flatten the core 20*a*, thus giving the core a desired flat cross-section.

During the operation of the unit 21, this unit 21 including the press roll unit 23 is rotated around the core passage. When the unit 21 is rotated around the core passage in a direction as shown by the arrow P of FIG. 12, the core 20*a* at the inlet A of the press roll unit 23 is primarily and spirally twisted to form a Z-twist structure. That is, since the core 20*a* is tightly positioned under pressure in the nips between the rolls 23*a*, 23*b* and 23*c* within the housing 22, the core 20*a* is rotated along with the rotating action of the housing 22, thus being primarily twisted to a Z-twist structure at the inlet A of the roll unit 23 prior to being rolled by the roll unit 23.

The flat core 20*a*, extended from the roll unit 23, is secondarily twisted to form an S-twist structure at the outlet C of the roll unit 23 prior to being distributed from the housing 22 through the guide 26.

Therefore, the pressing process of the roll unit 23 fixes the primary Z-twist structure of the core 20*a* while flattening the core 20*a*. Thereafter, the flat core 20*a*, extended from the last roll pair 23*c*, is secondarily twisted to form an S-twist structure.

In a brief description, the S-twist of the core 20*a* at the outlet C of the roll unit 23 offsets the 2-twist of the core 20*a* formed at the inlet A of the roll unit 23. After the core 20*a* is twisted to form a Z-twist structure at the inlet A of the roll unit 23, the core 20*a* is deformed in its cross-section from a circular cross-section into a flat cross-section at the position B between the first and second roll pairs 23*a* and 23*b* while fixing the Z-twist structure. The flat core 20*a* is, thereafter, twisted at the outlet C of the roll unit 23 to form an S-twist structure, and so the resulting core 20*a* only has an S-twist appearance.

Therefore, it is possible to change the twisted direction of the core 20*a* to form an S- or Z-twist structure and/or to adjust the twisted pitch of the core 20*a* as desired by appropriately controlling the rotating direction and the rotating velocity of the core shaping unit 21.

In the core shaping unit 21 of this invention, it is possible to make a core 20*a* having both of the two twisting directions in addition to various pitches by sections in the lengthwise direction of the steel cord 20. In order to accomplish the above object, the drive motor of the power transmission mechanism 25 is appropriately controlled in the rotating direction and rotating velocity. In the above core shaping unit 21, it is possible to fabricate the press roll unit 23 using only one pair of press rolls or using several pairs of rolls. In order to accomplish a precise press rolling operation, a groove, having a predetermined size, is preferably formed along the circumferential pressing surface of each roll. In such a case, the press roll unit 23 makes a core 20*a* having a cross-section corresponding to the profile of the groove.

In the present invention, the core shaping unit 21 may be operated by the rotating force output from the rotary flyer or another rotary unit of a cord twisting device in place of the rotating force from the separate drive motor of the power transmission mechanism 25. That is, it is possible to design the core shaping unit 21 to be operated in conjunction with a rotary unit of the twisting device which will be described later herein.

That is, in the press rolling process for shaping the core 20*a*, the press roll unit 23 of the core shaping unit 21 is not operated by a rotating force output from the separate drive motor of the power transmission mechanism 25, but is rotated by the drawing force of the core 20*a* generated when the core 20*a* passes through the unit 23 in conjunction with the operation of the cord twisting device. The core shaping unit 23 thus flattens the core 20*a*. The flat core 20*a* is, thereafter, spirally twisted to form an S- or Z-twist structure by the cord twisting device. In such a case, it is possible to allow the core twisting process and the cord twisting process to be performed at the same time by a single device.

A desired steel cord of this invention is produced using a steel cord twisting device with the above core shaping unit 21 as shown in FIGS. 13 to 16.

FIGS. 13 to 16 are views, showing the process of producing a desired steel cord of this invention. Of FIGS. 13 to 16, the first shows a process of producing a steel cord having a 1+6 element wire structure using an out-in double twisting device, with the core shaping unit positioned just around a core supply bobbin. The second shows a process of producing a steel cord having a 1+6 element wire structure using an in-out double twisting device, with the core shaping unit positioned just around a core supply bobbin.

The two cord twisting processes, respectively using the two devices of FIGS. 13 and 14, will be described hereinbelow, with the same elements of the two devices being designated by the same reference numerals.

Figure 13:
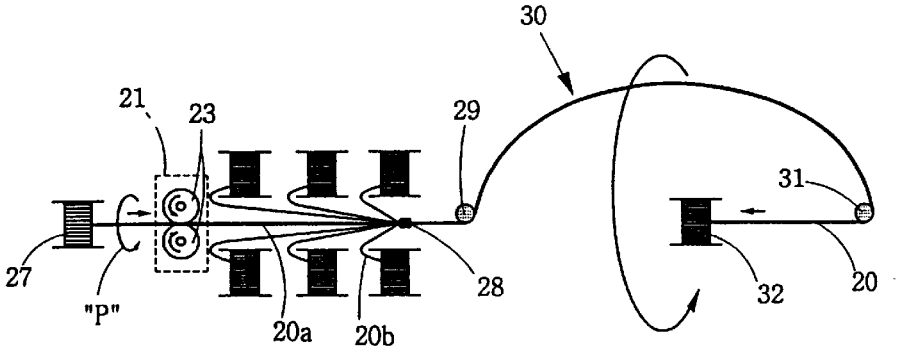
Figure 14:
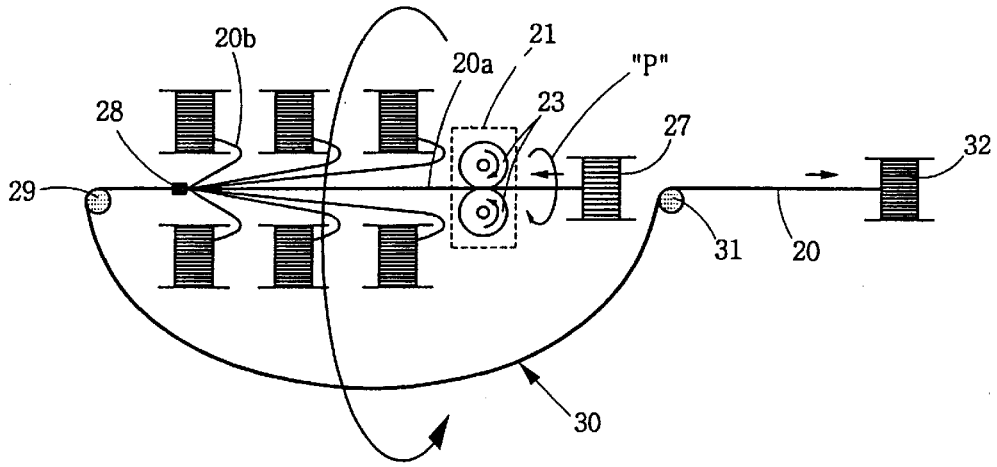

As shown in FIGS. 13 and 14, the core 20*a*, fed from a bobbin 27, primarily passes through the pressing nips of the press roll unit 23 of the core shaping unit 21, thus being cold-rolled to have a flat cross-section.

The press roll unit 23 of the core shaping unit 21 is not operated by a rotating force output from a separate drive motor, but is rotated by the drawing force of the core 20*a*, passing through the nips of the unit 23, in a direction as shown by the small arrows of FIGS. 13 and 14. In other words, the drawing force of the core 20*a* extended from the roll unit 23 of the core shaping unit 21 is used as the drive force for the roll unit 23.

In such a case, the core shaping unit 21, including the roll unit 23, is rotated at a velocity $N_s$ in the direction as shown by the small arrow P of FIG. 12.

Thereafter, six external element wires 20*b* are associated with the flat and spirally twisted core 20*a*, discharged from the core shaping unit 21, at a cabling point 28 of the device, thus forming an associated steel cord.

The above associated steel cord, having the external element wires 20*b* and the flat and spirally twisted core 20*a*, is primarily twisted by a rotating action of the rotary flyer 30 of the cord twisting device prior to passing over a guide A roller 29. In such a case, the flyer 30 is rotated at a rotating velocity $N_c$, and so the associated steel cord is primarily twisted by $N_c$.

Thereafter, the primarily twisted steel cord is secondarily or finally twisted by $N_c$ while passing over a direction guide roller 31 mounted on the rotary flyer 30 at a position opposite to the guider roller 29. The finally twisted steel cord 20 is guided to a take-up spool 32 of the cord twisting device, thus being wound around the spool 32 and finishing the process of producing the desired steel cord 20. In the device of FIG. 13, the take-up spool 32 is positioned within the rotary flyer 30, while the take-up spool 32 of the device of FIG. 14 is positioned outside the rotary flyer 30.

In order to control the quality of the resulting steel cord 20, both an over twister (not shown) and a correction roller (not shown) are installed on the core passage at positions between the direction guide roller 31 and the take-up spool 32 in the same manner as that of a conventional twisting device. Due to the over twister and the correction roller, it is possible for the device to preferably make a steel cord 20 free from any remaining torsion in addition to both an improvement in linearity of the cord 20 and a reduction in arc height.

Both the twisted direction and the pitch of the resulting steel cord 20 produced by each of the devices of FIGS. 13 and 14 relative to those of the core 20*a* will be described hereinbelow.

When both the core shaping unit 21 and the rotary flyer 30 are rotated in the same direction, the core 20*a* is primarily twisted by N, per core moving length at the outlet of the core shaping unit 21. On the other hand, the cord 20, formed from an association of the core 20*a* with the external element wires 20*b*, is double-twisted by $2N_c$ in a direction opposite to the primarily twisted direction of the core 20*a* at each 360° C. rotating action of the rotary flyer 30. Therefore, the $2N_c$-twist of the core 20*a*, formed by the rotary flyer 30, offsets the $N_s$-twist formed by the core shaping unit 21, and so the final structure of the core 20*a* is defined by a $2N_c-N_s$ twist, which extends in the same direction as the twisted direction of the resulting cord 20. In such a case, the cord 20 has a $2N_c$-twist structure.

On the other hand, when the core shaping unit 21 is rotated in a direction opposite to that of the rotary flyer 30, the core 20*a* is primarily twisted by $N_s$ per core moving length at the outlet of the core shaping unit 21 and is secondarily twisted by $2N_c$ due to the rotating action of the rotary flyer 30. Therefore, the core 20*a* of a resulting steel cord 20 finally has a twisted structure, wherein the core 20*a* is twisted by $2N_c+N_s$ in the same direction as the twisted direction of the resulting cord 20.

As well known to those skilled in the art, the pitch $P_s$ of the twisted core 20*a* within the steel cord 20 produced by each of the double twisting devices of FIGS. 13 and 14 may be adjustable by controlling the pitch $P_c$ of the cord 20 and the rotating velocity ($N_c$) of the device in addition to the rotating velocity ($N_s$) of the core shaping unit 21 as will be expressed in the following expression of relation (2).

Expression of Relation (2)

$$P_s=2P_c/\{2\pm(N_s/N_c)\}$$

In the above expression (2), the symbol "+" is selected in the case of the core shaping unit 21 rotated in the same direction as the rotating direction of the rotary flyer 30. Meanwhile, the symbol "−" is selected in the case of the core shaping unit 21 rotated in a direction opposite to the rotating direction of the rotary flyer 30. In addition, when $P_s$ is higher than zero, the twisted direction of the core 20*a*is the same as that of the cord 20. Meanwhile, when $P_s$ is less than zero, the twisted direction of the core 20*a* is opposite to that of the cord 20.

On the other hand, the relation between the pitch $P_s$ of the twisted core 20*a* and the pitch $P_c$ of the cord 20 is as follows. That is, when the cord 20 is twisted in the same direction as the twisted direction of the core 20*a*, the twisted external element wires 20*b* extend in almost parallel to the twisted core 20*a* within a range of $0.9P_c$−$1.1P_c$, thus undesirably reducing both the penetration of the rubber material into the cord 20 and the structural stability of the cord 20.

When $P_s$>$0.2P_c$, the core 20*a* has to be exceedingly twisted within a unit length, thus forcing the core shaping unit 21 to be rotated at an exceedingly high velocity and reducing productivity while producing the steel cord 20.

Figure 15:
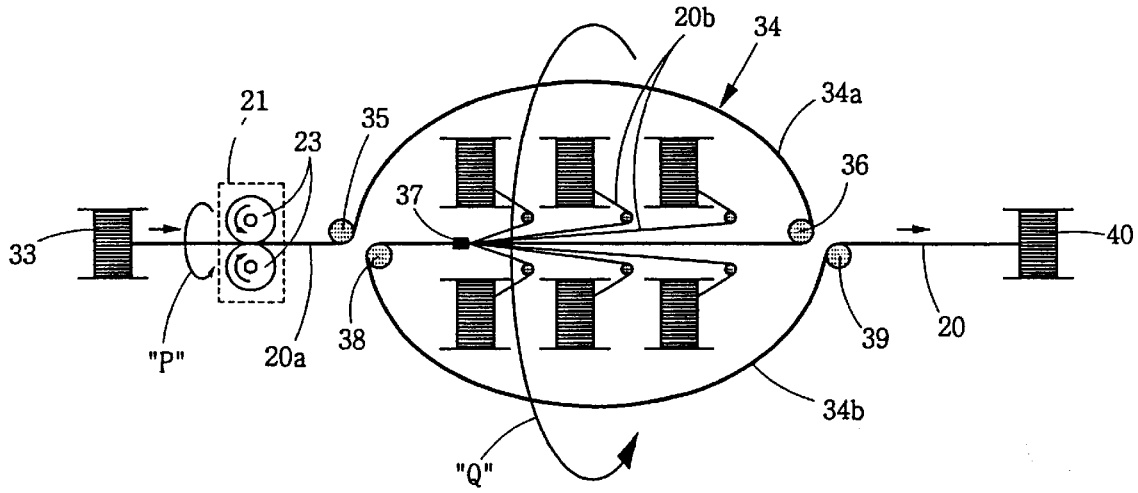

FIG. 15 shows a cord production process of this invention using an in-out double twisting device of the type different from the device of FIG. 14. As shown in the drawing, this in-out double twisting device has a core shaping unit 21 at a position just around a core supply bobbin 23. In the operation of the device, a core 20*a*, fed from the bobbin 33, primarily passes through the core shaping unit 21 while being cold-deformed in cross-section from a circular cross-section into a flat cross-section and being lengthwisely and spirally twisted.

That is, the core 20*a*, extended from the bobbin 33 positioned outside the cord twisting device, passes through the nips of the press roll unit 23 within the core shaping unit 21 prior to reaching a double twisting unit 31 consisting of first and second rotary flyers 34*a* and 34*b*.

In such a case, the press roll unit 23 of the core shaping unit 21 is not operated by a rotating force output from a separate drive motor, but is rotated by the drawing force of the core 20*a*, passing through the nips of the roll unit 23, in a direction as shown by the small arrow P of FIG. 15. In other words, the drawing force of the core 20*a* extended from the roll unit 23 of the core shaping unit 21 is used as the drive force for the roll unit 23.

In such a case, the core shaping unit 21, including the roll unit 23, is rotated at a velocity $N_s$ in the direction as shown by the arrow P of FIG. 15.

The flat and spirally twisted core 20*a*, fed from the core shaping unit 21, passes over first and second direction guide rollers 35 and 36 prior to reaching a cabling point 37 within the double twisting unit 34, thus being associated with six external element wires 20*b* at the cabling point 28 and forming an associated steel cord. The above first direction guide roller 35 is positioned outside the first end of the first rotary flyer 34*a*, while the second direction guide roller 36 is positioned inside the second end of the rotary flyer 34*a*.

Thereafter, the above associated steel cord, having the external element wires 20*b* and the flat and spirally twisted core 20*a*, passes over third and fourth direction guide rollers 38 and 39 prior to reaching a take-up spool 40, around which the resulting cord 20 is wound to finish the process of producing the cord 20. In the device of FIG. 15, the third and fourth rollers 38 and 39 are positioned at opposite ends of the second rotary flyer 34*b*, while the take-up spool 40 is positioned outside the double twisting unit 34.

Since the two rotary flyers 34*a* and 34*b* of the above device are held on opposite ends of a shaft of the double twisting unit 34, they are rotated at the same rotating velocity in a direction as shown by the arrow Q of FIG. 15.

Both the twisted direction and the pitch of the resulting steel cord 20 produced by the above device relative to those of the core 20*a* will be described hereinbelow.

When both the core shaping unit 21 and the two rotary flyers 34*a* and 34*b* are rotated in the same direction, the core 20*a* is primarily twisted by $N_s$ per core moving length at the outlet of the core shaping unit 21. On the other hand, the cord 20, formed from an association of the core 20*a* with the external element wires 20*b*, is primarily double-twisted by $2N_c$ in a direction opposite to the twisted direction of the primarily twisted core 20*a* at each 360° rotating action of the first rotary flyer 34*a*. The cord 20 is also secondarily twisted by $2N_c$ in the same direction as that of the twisted direction of the core 20*a* at each 360° rotating action of the second rotary flyer 34*b*. Therefore, the second $2N_c$-twist of the core 20*a*, formed by the second rotary flyer 34*b*, offsets the first $2N_c$-twist formed by the first rotary flyer 34*b*, and only the $N_s$-twist, formed by the core shaping unit 21, remains in the final structure of the core 20*a*. The above $N_s$-twist of the core 20*a* extends in the same direction as the twisted direction of the resulting cord 20. In such a case, the cord 20 has a $2N_c$-twist structure.

On the other hand, when the core shaping unit 21 is rotated in a direction opposite to that of the two rotary flyers 34*a* and $34_b$, the core 20*a* is primarily twisted by $N_s$ per core moving length at the outlet of the core shaping unit 21 and is secondarily twisted by $2N_c$−$2N_c$ due to the rotating actions of the two rotary flyers 34*a* and 34*b*. Therefore, the core 20*a* of a resulting steel cord 20 finally has a twisted structure, wherein the core 20*a* is twisted by $N_s$+($2N_c$−$2N_c$) in a direction opposite to the twisted direction of the resulting cord 20.

In the same manner as that described for the double twisting devices according to the embodiments of FIGS. 13 and 14, the pitch $P_s$ of the twisted core 20*a* within the steel cord 20 produced by the double twisting device of FIG. 15 may be adjustable by controlling the pitch $P_c$ of the cord 20 and the rotating velocity ($N_c$) of the device in addition to the rotating velocity ($N_s$) of the core shaping unit 21 as will be expressed in the following expression of relation (3).

Expression of Relation (3)

$$P_s=\pm 2Pc(N_c/N_s)$$

In the above expression (3), the symbol "−" is selected in the case of the core shaping unit 21 rotated in the same direction as the rotating direction of the two rotary flyers 34*a* and 34*b*. Meanwhile, the symbol "+" is selected in the case of the core shaping unit 21 rotated in a direction opposite to the rotating direction of the two rotary flyers 34*a* and 34*b*.

Figure 16:
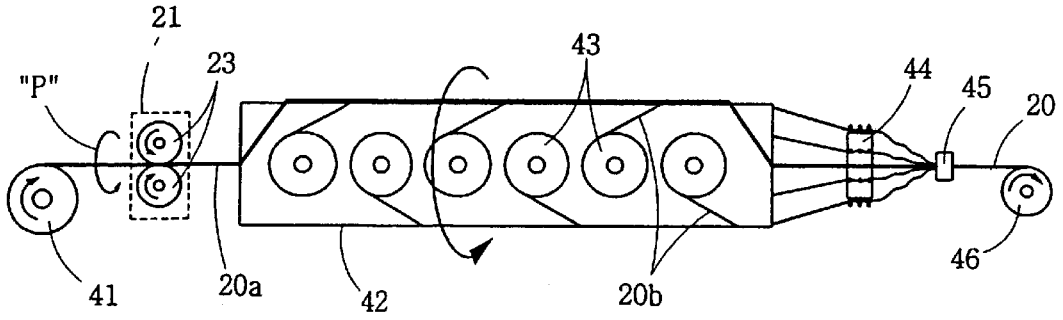

FIG. 16 shows a cord production process using a tubular-type twisting device in accordance with the present invention. As shown in the drawing, this tubular-type twisting device has a core shaping unit 21 at a position just around a core supply bobbin 41. In the operation of the device, a core 20*a*, fed from the bobbin 41, primarily passes through the core shaping unit 21 while being cold-deformed in cross-section from a circular cross-section into a flat cross-section and being lengthwisely and spirally twisted.

That is, the core 20*a*, extended from the bobbin 41, passes through the nips of the press roll unit 23 within the core shaping unit 21 prior to reaching the rotary flyer 42 of the twisting device.

In such a case, the press roll unit 23 of the core shaping unit 21 is not operated by a rotating force output from a separate drive motor, but is rotated by the drawing force of the core 20*a*, passing through the nips of the roll unit 23, in a direction as shown by the small arrow P of FIG. 16. In other words, the drawing force of the core 20*a* extended from the roll unit 23 of the core shaping unit 21 is used as the drive force for the roll unit 23.

During the steel cord production process, the core shaping unit 21, including the roll unit 23, is rotated at a velocity $N_s$ in the direction as shown by the arrow P of FIG. 16.

The flat and spirally twisted core 20*a*, fed from the core shaping unit 21, moves to the rotary flyer 42 while being guided by a core guide means (not shown) provided on the rotary flyer 42.

On the other hand, a plurality of external element wire supply bobbins 43 are seated on a cradle within the rotary flyer 42 and individually supply an external element wire 20*b* to a preforming unit 44, which is positioned around the outlet end of the flyer 42. In such a case, the external element wires 20*b* fed from the bobbins 43 are guided along the external surface of the rotary flyer 42 prior to passing through the preforming unit 44. The above wires 20*b* are preformed while passing through the preforming unit 44 and are twisted around the core 20*a* by a poise 45 to form a desired steel cord 20. The above steel cord 20, fed from the poise 45, passes through both an over twister (not shown) and a correction roller (not shown) prior to being wound around a take-up spool 46. In such a case, the object of both the over twister and the correction roller is to control the quality of 20 the resulting steel cord 20.

When the core shaping unit 21 is rotated in the same direction as that of the rotary flyer 42 in the operation of the above tubular-type twisting device, the core 20*a* within the resulting cord 20 has an $N_s$-twist structure, which is formed by the core shaping unit 21 regardless of the rpm of the rotary flyer 42, with the $N_s$-twist of the core 20*a* extending in the same direction as the twisted direction of the resulting cord 20.

On the other hand, when the core shaping unit 21 is rotated in a direction opposite to that of the rotary flyer 42, the core 20*a* within a resulting cord 20 is twisted by $N_s$ in a direction opposite to the twisted direction of the resulting cord 20.

In the resulting steel cord 20 produced by the device of FIG. 16, the pitch $P_s$ of the twisted core 20*a* will be expressed in the following expression of relation (4).

Expression of Relation (4)

$$P_s = \pm Pc(N_c/N_s)$$

In the above expression (4), the symbol "−" is selected in the case of the core shaping unit 21 rotated in a direction opposite to the rotating direction of the rotary flyers 42. Meanwhile, the symbol "+" is selected in the case of the core shaping unit 21 rotated in the same direction as the rotating direction of the rotary flyer 42.

A better understanding of the present invention may be obtained through the following examples which are set forth to illustrate, but are not to be construed as the limit of the present invention.

EXAMPLE 1 AND COMPARATIVE EXAMPLES 1 TO 5

In order to compare the characteristics of a steel cord of this invention of FIG. 6 with the conventional steel cords of FIGS. 1 to 5, six steel cord samples (Example 1 and Comparative Examples 1 to 5) were produced under the conditions expressed in Table 1. In such a case, each of the steel cord samples were individually produced using a core having a diameter of 0.34 mm in addition to six external element wires individually having a diameter of 0.32 mm. Each of the above core and wires was produced from a high-carbon steel wire (POSCORD 80), having 0.82 wt % of carbon and a diameter of 5.5 mm, through an acid rinsing process, a dry drawing process, a heat treating process, a brass coating process and a fine wet drawing process.

After the steel cord of Example 1 (this invention) and the steel cords of Comparative Examples 1 to 5 (prior art) were produced, the characteristics of all the six steel cords, such as buckling fatigue resistance, rubber adhesive force, rubber penetration, air permeability, breaking strength, low load elongation, workability and the amount of Fe dissolved from the brass-layered surface, were measured. The measuring results are given in Table 1.

TABLE 1

| Content | Example 1 (FIG. 6) Flat core having twist pitch | | Com. Ex. 1 (FIG. 1) Double layered cord | Com. Ex. 2 (FIG. 2) Rolled cord | Com. Ex. 3 (FIG. 3) Single core | Com. Ex. 4 (FIG. 4) Flat core | Com. Ex. 5 (FIG. 5) Externally preformed |
|---|---|---|---|---|---|---|---|
| Structure | 1x0.34 + 6x0.32 | 1x0.34 + 6x0.32 | 3x0.2 + 6x0.32 | 6x0.32 | 1x0.34 + 6x0.32 | | |
| Flatness ratio (F) | 1.6 | 1.25 | | | | 1.6 | |
| Cord diameter (mm) | 1.00 | 1.04 | 1.09 | 0.97 | 0.98 | 0.03 | 1.06 |
| Pitch (mm) | 10/14 | 10/14 | 7/14 | 14 | 14 | 14 | 14 |
| Lay direction | S/S | S/S | S/Z | S | S | S | S |
| Breaking strength (kgf) | 170.4 | 170.52 | 170.8 | 142.2 | 170.3 | 170.6 | 169.2 |
| Buckling fatigue resist* | 118 | 112 | 100 | 87 | 95 | 96 | 89 |
| Rubber penetration* | 100 | 95 | 90 | 100 | 10 | 25 | 95 |
| Air permeability (min) | 25.3 | 21.5 | 8.8 | 24.5 | 1.2 | 1.6 | 21.8 |

TABLE 1-continued

| Content | Example 1 (FIG. 6) Flat core having twist pitch | | Com. Ex. 1 (FIG. 1) Double layered cord | Com. Ex. 2 (FIG. 2) Rolled cord | Com. Ex. 3 (FIG. 3) Single core | Com. Ex. 4 (FIG. 4) Flat core | Com. Ex. 5 (FIG. 5) Externally preformed |
|---|---|---|---|---|---|---|---|
| Structure | 1x0.34 + 6x0.32 | 1x0.34 + 6x0.32 | 3x0.2 + 6x0.32 | 6x0.32 | 1x0.34 + 6x0.32 | | |
| Amount of dis-solved Fe ($g/m^2$) | 0.22 | 0.23 | 0.22 | 0.37 | 0.23 | 0.23 | 0.45 |
| Rubber adhes. force (kgf) | 82.8 | 82.2 | 81.5 | 78.5 | 75.8 | 77.6 | 82.4 |
| Ageing adhes. force (kgf) | 81.5 | 79.8 | 78.6 | 77.4 | 48.8 | 52.2 | 80.1 |
| Low load elong. (%) | 0.03 | 0.03 | 0.04 | 0.55 | 0.03 | 0.04 | 0.18 |
| Elong. at Frac-ture (%) | 2.5 | 2.6 | 2.6 | 4.3 | 2.6 | 2.7 | 3.2 |
| Core migrat. resist. | ◎ | ◎ | ◎ | — | x | Δ | ○ |
| Work-ability | ◎ | ◎ | ◎ | x | ◎ | ○ | x |

Figure 1:
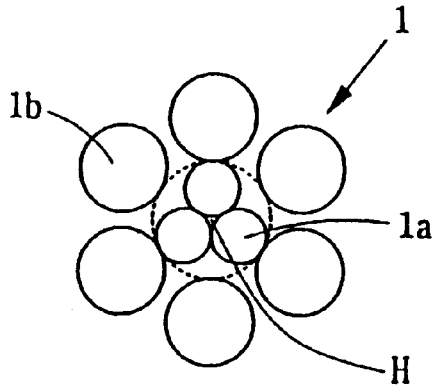
Fig. 1 PRIOR ART
FIG. 1 is a sectional view of a conventional steel cord in 10 having a 3+6 element wire structure.
Figure 2:
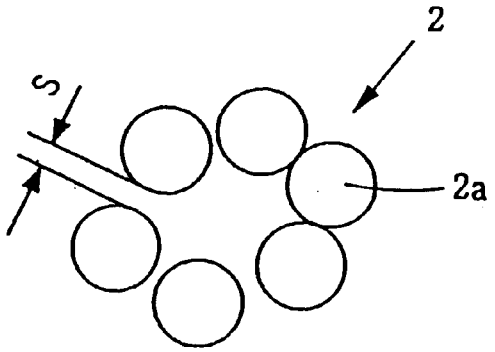
Fig. 2 PRIOR ART
FIG. 2 is a sectional view of a conventional steel cord, having six preformed element wires twisted together to form a cord and being externally forced to be flattened.
Figure 3:
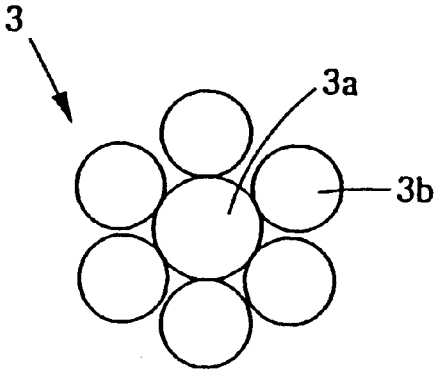
Fig. 3 PRIOR ART
FIG. 3 is a sectional view of a conventional steel cord having a 1+6 element wire structure, with the core having a circular cross-section.
Figure 4:
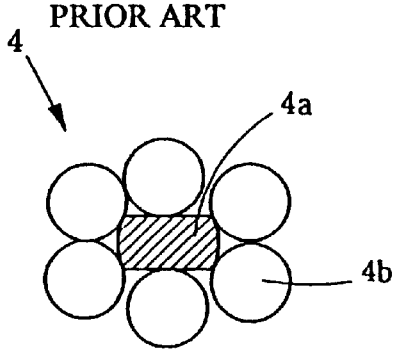
Fig. 4 PRIOR ART
FIG. 4 is a sectional view of a conventional steel cord having a 1+6 element wire structure, with the core being flattened.
Figure 5:
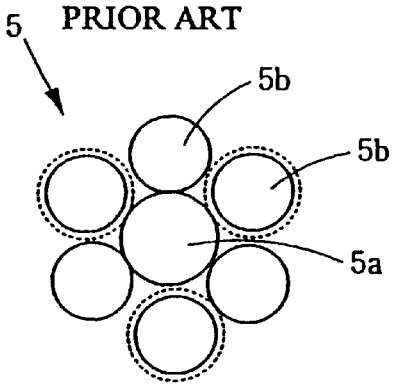
Fig. 5 PRIOR ART
FIG. 5 is a sectional view of a conventional steel cord having a 1+6 element wire structure, with the core having a circular cross-section and some external element wires being preformed.

In the above table 1, the buckling fatigue resistance and the rubber penetration of the steel cord samples, both being added with a mark *, were measured in percentages relative to the reference steel cord sample of Comparative Example 1 of FIG. 1.

First, the buckling fatigue resistance was measured as follows. That is, each steel cord sample was set within a molded rectangular rubber sample having a sectional area of 5 mm (length) ×2.5 mm (width). The molded rubber samples, each having a steel cord sample, were vulcanized under predetermined vulcanizing conditions using a rubber compound having 100% modulus of 35 $kgf/cm^2$. After the vulcanization, three buckling pulleys of a three-roll buckling fatigue tester were repeatedly moved to the left and right while counting the number of reciprocating cycles of the three buckling pulleys until the steel cord sample within each rubber sample was fractured due to, for example, abrasion fatigue. The counted number of reciprocating cycles was compared with that of the reference sample of Comparative Example 1 of FIG. 1.

Second, the rubber penetration was measured as follows. That is, each steel cord sample was set within a rubber sample prior to vulcanization of the rubber sample. After the vulcanization, the lengthwise rubber, penetrated into and lengthwisely filled in the central space of each steel cord sample, was checked in its lengthwisely filled state prior to converting the checked result into a length unit. The measured rubber penetration characteristics of the six steel cord samples were compared with each other and are given in Table 1, wherein the value "100" of the rubber penetration means that the central space of a steel cord sample is completely and fully filled with rubber.

Third, the air permeability was measured as follows. That is, each steel cord sample having a length of 25 mm was set within a molded rectangular rubber sample having a circular cross-sectional area of Π× (5 mm(diameter)/2) $^2$. The molded rubber samples, each having a steel cord sample, were vulcanized under predetermined vulcanizing conditions using a rubber compound having 100% modulus of 35 $kgf/cm^2$. After the vulcanization, each rubber sample having a steel cord sample was positioned to measure the air permeability, with one end of the rubber sample positioned under atmospheric pressure and the other end positioned within a vacuum chamber of 0.5 atm. The air permeability was measured by checking the time 25 ml of air moved from atmosphere into the vacuum chamber through each rubber sample.

Fourth, the amount of Fe, dissolved from the brass-layered surface of each steel cord sample, was measured to determine the degree of damage, if any, of the brass layer of each steel cord sample. Such an amount of dissolved Fe was measured as follows. That is, the amount ($g/m^2$) of Fe dissolved from a unit area ($m^2$) of the brass-layered surface of each steel cord sample was measured under predetermined conditions, 0.5N—$HNO_3$ (solution) ×22° C. (Temperature) ×1 min (time), through an iron dissolution test. In this test, the amount of dissolved Fe per unit time was increased in proportion to damage of the brass-layered surface of each steel cord sample.

Fifth, the rubber adhesive force test was performed through ASTM 2229 (American Standard Testing Method 2229), while the ageing adhesive force test was performed under the condition of 70° C.×96%RH×7 days through MPA (Moisture Permeation Adhesion).

Sixth, the low load elongation (%) was determined from an elongation of each steel cord sample when each cord sample was loaded with 0.25–3.0 kgf. The low load elongation (i) is in inverse proportion to workability of each steel cord sample.

Seventh, the core migration of each steel cord sample indicates the adhesion force between the core and the external element wires within each steel cord sample. In the Table 1, the characters ◎, ○, Δ and x for the core migration respectively stand for excellent, good, normal and bad.

Last, the workability indicates whether each steel cord sample is easy or not to handle during a process of producing a desired tire. Due to the twist-structural stability of steel cords, each steel cord sample has an improved workability in inverse proportion to its low load elongation. In the Table 1, the characters ◎, ○, Δ and x for the workability respectively represent excellent, good, normal and bad.

As expressed in Table 1, the steel cord sample of Example 1 (this invention) is remarkably improved in buckling fatigue resistance in comparison with the steel cord samples of Comparative Examples 1 to 5 (prior art). This is caused by the fact that the steel cord of this invention has an improved rubber penetration, thus accomplishing a complete filling of rubber within its interspaces between the core and the external element wires and between the external element wires. The rubber, filled in the interspaces of the steel cord, acts as an impact absorbing material within the steel cord, thus effectively preventing the core and external element wires from coming into direct frictional contact with each other even in the case of application of repeated tensile and compression stress. This finally improves the abrasion resistance of steel cords.

In accordance with the test for the amount of Fe dissolved from the brass-layered surface of the steel cord samples, it is noted that the steel cord sample of Comparative Example 5 (FIG. 5) has a large amount of dissolved Fe since the brass layer of each wire was damaged during a partial preforming process for the wires. Meanwhile, the steel cord sample of this invention has an open structure free from such a preforming process, thus being almost free from such Fe dissolution in the same manner as expected from the steel cord sample of Comparative Example 1 (FIG. 1).

The steel cord of this invention is also remarkably improved in its ageing adhesive force with rubber in comparison with the conventional steel cords. This is caused by the fact that the steel cord of this invention is formed by twisting wires, which form interspaces within the steel cord while being free from a preforming process or from being damaged on its brass layer. The ageing adhesive force of this steel cord with rubber is further improved due to the structure of the steel cord designed to accomplish an improved rubber penetration in the same manner as that described for the air permeability.

The steel cord sample of Example 1 (this invention) has a low load elongation of not higher than 0.03%, which is significantly lower than those of the steel cord samples of Comparative Examples 1 to 5 (prior art). The steel cord of this invention has a remarkably improved workability during a process of producing steel belted radial tires.

As described above, the present invention provides a reinforcing steel cord for rubber products, which is formed by twisting a plurality of external element wires around a core, the core being flat and spirally twisted to have a desired regular pitch. Due to the above specifically twisted structure of the steel cord, a plurality of interspaces are formed between the core and wires and between the wires and provide the following advantages.

Due to the above interspaces, the steel cord of this invention improves the rubber penetration into the cord, thus allowing rubber to be fully filled in the cord. This finally improves both the abrasion resistance and rubber adhesive force of the cord, and preferably increases the expected life span of rubber products, such as tires, using the steel cords of this invention as reinforcing materials.

In the steel cord of this invention, the space, occupied by the core, is enlarged by geometrically flattening and twisting the core, thus effectively forming interspaces between the core and the external element wires and between the wires. During a process of producing rubber products, rubber, used as an impact absorbing material, is effectively penetrated into and completely filled in the cord. The rubber within the steel cord thus effectively prevents the core and external element wires from coming into direct frictional contact with each other even in the case of application of repeated tensile and compression stress. This improves the abrasion resistance and buckling fatigue resistance of steel cords, thus finally improving durability of resulting tires.

Since the rubber penetration of this steel cord is improved, the adhesion force between the core and external element wires in the steel cord is increased and allows the steel cord to be free from core migration.

The steel cord of this invention accomplishes a desired open structure, with the wires forming desired interspaces within the cord while being free from a mechanically preforming process easily scratching or damaging the brass layer of each wire. Therefore, it is possible for the steel cord of this invention to have desired adhesion interfaces for rubber.

In this steel cord, the flat and spirally twisted core is axially positioned at the center of the cord while reducing the low load elongation of the cord. This finally allows the steel cords to be free from being undesirably deformed in their structures by external pressure during a vulcanization process. That is, it is possible to stabilize the structure of the cords during such a vulcanization process of tires, thus finally improving workability of the cords during a tire production process.

In a brief description, due to the flat and spirally twisted core axially positioned at the center of the steel cord of this invention, the steel cord is improved in buckling C fatigue resistance, rubber penetration, rubber adhesive force and ageing adhesive force in addition to almost complete protection of the brass layer of each wire. It is also possible for the present invention to improve the workability of the steel cords while producing a desired rubber product. Therefore, the steel cord of this invention may be most preferably used as a reinforcing material for steel belted radial tires.

The process of producing steel cords of this invention effectively manufactures desired steel cords through a single twisting process in place of a conventional double twisting process. The present invention thus preferably simplifies the steel cord production process in addition to a simplification of the steel cord production device and a conservation of cord production time and a reduction in the production cost of steel cords.

The steel cord production device of this invention is accomplished by simply installing a core shaping unit at a position just around a core supply bobbin within a conventional steel cord twisting device. Therefore, this invention is advantageous in that it is possible to produce desired steel cords using such a conventional twisting device without complicating the construction of the device.

Another advantage of this invention resides in that the core shaping unit is designed to be rotated by the rotating force of the cord twisting device without using the rotating force of any separate motor, thus conserving energy and improving the energy efficiency of the device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A reinforcing steel cord for rubber products, comprising:

a core formed by cold-rolling an original steel element wire having a circular cross-section to give the wire a flat cross-section, said core being also lengthwisely and spirally twisted, thus finally having a flat and spirally twisted structure; and "n" number of external element wires twisted around said flat and spirally twisted core to form a steel cord having a 1+n element wire structure;

wherein said flat and spirally twisted core has both a flatness ratio of 1.05–2.0 and a pitch being 0.2 to 2 times a pitch of said external element wires;

wherein a diameter of said original element wire of the core is 1+0.3 times a diameter of each of said external element wires; and wherein said original element wire of the core having the circular cross-section is cold-rolled to be flattened at its opposite surfaces, with remaining surfaces being kept rounded to have arcuate surfaces.

2. The reinforcing steel cord according to claim 1, wherein said number "n" is one of three to nine.

* * * * *